US009687707B2

(12) United States Patent
Goldstein

(10) Patent No.: US 9,687,707 B2
(45) Date of Patent: Jun. 27, 2017

(54) TENNIS NET TENSION SYSTEM INCLUDING SERVICE LET INDICATION FEATURE

(71) Applicant: Group One Limited, Ramsey (GB)

(72) Inventor: Fredric Goldstein, Nacka (SE)

(73) Assignee: Group One Limited, Ramsey, British Isles (IM)

( * ) Notice: Subject to any disclaimer, the term of this patent is extended or adjusted under 35 U.S.C. 154(b) by 76 days.

(21) Appl. No.: 14/646,230

(22) PCT Filed: Nov. 27, 2013

(86) PCT No.: PCT/US2013/072408

§ 371 (c)(1),
(2) Date: May 20, 2015

(87) PCT Pub. No.: WO2014/085708

PCT Pub. Date: Jun. 5, 2014

(65) Prior Publication Data

US 2015/0283439 A1 Oct. 8, 2015

Related U.S. Application Data

(60) Provisional application No. 61/737,284, filed on Dec. 14, 2012, provisional application No. 61/730,238, filed on Nov. 27, 2012.

(51) Int. Cl.

| | |
|---|---|
| ***A63B 61/00*** | (2006.01) |
| ***A63B 61/04*** | (2006.01) |
| *A63B 71/06* | (2006.01) |

(52) U.S. Cl.

CPC ..... *A63B 61/04* (2013.01); *A63B 71/0608* (2013.01); *A63B 61/003* (2013.01);
(Continued)

(58) Field of Classification Search

CPC ..... A63B 61/00; A63B 61/003; A63B 61/04; A63B 71/06; A63B 71/0605;
(Continued)

(56) References Cited

U.S. PATENT DOCUMENTS 401,082 A * 4/1889 Taylor ..... A63B 61/04 473/495
4,081,798 A * 3/1978 Pelfrey ..... A63B 71/0605 340/323 R (Continued)

FOREIGN PATENT DOCUMENTS

| | | |
|---|---|---|
| CN | CN2198948 | 9/2011 |
| DE | 3942255 A1 | 7/1991 |
| GB | 2070942 A | 9/1981 |

OTHER PUBLICATIONS

International Preliminary Report on Patentability for International Application No. PCT/US2013/072408 mailed Jun. 11, 2015.

(Continued)

*Primary Examiner* — Raleigh W Chiu
(74) *Attorney, Agent, or Firm* — Carlson, Gaskey & Olds, P.C.

(57) ABSTRACT

Disclosed is system and method for measuring the tension of a tennis net, and, alternatively or in addition, for determining if a service let occurs via the measuring of the net tension. The disclosed embodiments measure a force exerted on the center-strap or the singles stick by the net. In these embodiments, the measured force provides an accurate reflection of the tension of the net.

20 Claims, 4 Drawing Sheets

(52) U.S. Cl.
CPC ..... *A63B 2071/0613* (2013.01); *A63B 2071/0625* (2013.01); *A63B 2220/51* (2013.01)

(58) Field of Classification Search
CPC ..... A63B 71/0608; A63B 71/0619; A63B 71/0622; A63B 2071/0613; A63B 2071/0625; A63B 2220/51
See application file for complete search history.

(56) References Cited

U.S. PATENT DOCUMENTS 4,844,455 A * 7/1989 Funkhouser, Jr. ..... A63B 61/02 473/493
4,973,055 A * 11/1990 Muir ..... A63B 61/04 24/625
5,320,344 A * 6/1994 Henderson ..... A63B 61/04 473/494
5,585,778 A * 12/1996 Brauer ..... A63B 71/0605 473/467
6,248,030 B1 * 6/2001 Pierce ..... A63B 61/02 473/490
7,823,466 B2 * 11/2010 Glass ..... G01L 5/06 73/826
8,806,952 B1 * 8/2014 Glass ..... A63B 61/02 177/232
2005/0164811 A1 * 7/2005 Barbier ..... A63B 61/04 473/494
2007/0099732 A1 * 5/2007 Scarpa, III ..... A63B 61/02 473/490
2011/0230265 A1 9/2011 Amit
2012/0295743 A1 * 11/2012 Williams ..... A63B 61/04 473/495
2015/0283439 A1 * 10/2015 Goldstein ..... A63B 61/04 473/493

OTHER PUBLICATIONS

European Search Report for EP Application 13858909.8 Dated Jun. 15, 2016.

* cited by examiner

TENNIS NET TENSION SYSTEM INCLUDING SERVICE LET INDICATION FEATURE

RELATED APPLICATIONS

This application claims the benefit of U.S. Provisional Application No. 61/730,238, filed Nov. 27, 2012. This application also claims the benefit of U.S. Provisional Application No. 61/737,284, filed Dec. 14, 2012. The entirety of each of these disclosures is herein incorporated by reference.

BACKGROUND

On all tennis courts, perhaps the most notable part is the net. In one known example, a tennis net includes two main net posts placed at a pre-determined height (e.g., 107 cm), and positioned a distance (e.g., 91.4 cm) outside the outermost (or doubles) sidelines of a tennis court. The net is typically composed of a woven or plastic netting supported by an upper net cable. The netting hangs from a strong metal cable via a white net tape. The net cable is attached to one post and then to the opposite post, which has a crank that winds the cable so that the net tightens and rises up to the required height and a desired tension.

In the middle of the net, there is a center-strap (also known as a mid-strap) which holds the net down by coming over the top of the net and being fastened to a clasp on the playing surface. This provides greater tension than a crank could practically provide (by pulling down at the mid-point of the net), since cables generally will sag, and provides the defined low part of the net in the center, and at an determinable height, which is an important during play. The result is a semi-V shape running in the top part of the net, where the center strap provides the regulation 91.4 cm height of the net in the middle.

In many tennis tournaments throughout the world, each net can be different. Wimbledon is known for a loose net while the U.S. Open is known for having a tight highly tensioned net. In fact, because both tournaments are outdoors, the net may be taken down as much as several times on any particular day with inclement weather. From tournament to tournament, and court to court, and even from day to day, and hour to hour, there lacks a precise, uniform net tension in tennis. And with this varying net tension, comes varying net heights (as net height is directly correlated to net tension, as explained further below).

When net tension is different, balls that clip the very top of the net ("net tape") during a rally will dribble over a loose net (resulting in what is called a cheap point), as a net with a looser tension absorbs the forward movement of the ball, allowing balls which hit the tape to roll over to the other side of the net. Conversely, with a tight net, the ball that clips the net tape will either sit up for an easy put away, or bounce out for a loss of the point, as tighter tensions do not absorb the forward pace and either send balls hitting the tape backward or cause the ball to change trajectory and fly out. This causes inconsistency in playing conditions.

Additionally, as mentioned, when net tension is different, the height of the net will be different. This is despite the fact that the net post is a defined height, as is the center-strap (107 cm and 91.4 cm respectively). The net traverses the court typically at 12.8 m in length (or 10.97 m for a singles net post). The net itself weighs approximately 10 kg (alternately approximately twice that for the ATP World Tour nets). Therefore, there will be a measurable sag in the net even when it is cranked up to reach the center-strap 91.4 cm height. The more one cranks thereafter, the tighter the net, thus as the net tension increases, the sag between the net posts/singles sticks and the center-strap will lessen, as the net cable will straighten out while being pulled tighter (resulting in different heights between those two points). This non-measured cranking (done essentially by "feel") can result in not only an inconsistent net tension but also an inconsistent net height. While the height of a net is the same for players on both sides, a player with more top spin will have an advantage over a player who hits a flatter ball when the net height can vary as much as several millimeters over the most of the playing area of the net (and as much as 1 cm at the midpoint between the singles stick and center-strap where the sag is greatest). Further, players who prefer to hit down the line (as opposed to cross court) will have a lower/higher net height at precisely that part of the net, with potentially different results of any such shot, depending upon the net tension. As the court itself has strictly defined dimensions and measurements in millimeters, as determined by the tennis governing bodies, and thus define the height of the net at any given point by virtue of knowing (and creating) the net tension.

For serves, the current rules call for a "service let," which is when the ball clips the net and still falls inside the service box. Loose nets will likely result in more lets while tight nets more likely cause the ball to either bounce back, sit up, or fly further and thus out (a "fault"). Professional tennis had recently considered removing the "service let." Should this still happen in the future, more "aces" will occur with loose nets (as the ball dribbles over to the other side) while tight nets will cause more balls to sit up for easy winners by the opponent or will go fly out for a loss of the point. The result is different depending upon the net tension. This is unacceptable, as the effect can be different on different courts and even change on the same court on the same day when the net often needs to be taken down on outdoor courts during rain, or to change nets during events with different tours (which have different nets). The result is an ever varying net tension and height for virtually each time a net is set up.

SUMMARY

There is a need for consistency in net tension across tennis. Disclosed is system and method for measuring the tension of a tennis net, and, alternatively or in addition, for determining if a service let occurs via the measuring of the tension. The disclosed embodiments measure a force exerted by the net on a center-strap or a singles stick. In these embodiments, the measured force provides an accurate reflection of the tension of the net.

The embodiments, examples and alternatives of the preceding paragraphs, the claims, or the following description and drawings, including any of their various aspects or respective individual features, may be taken independently or in any combination. Features described in connection with one embodiment are applicable to the other embodiments, unless such features are incompatible.

DETAILED DESCRIPTION

Figure 1:
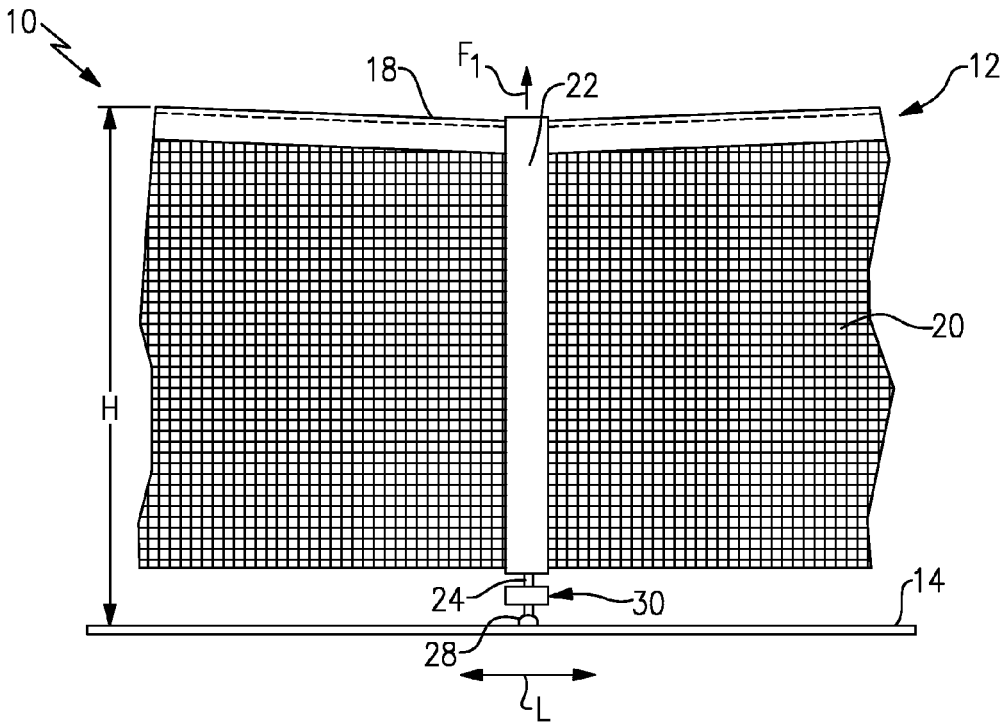
FIG. 1 is a view of an example net tension system.

FIG. 1 illustrates an example net tension system 10. The system 10 is used in connection with a net 12, which spans a playing area 14 in a direction of its length L. The playing area 14 in one example is a tennis court, and the net 12 is a tennis net. This disclosure may be used outside of tennis, however.

Figure 4:
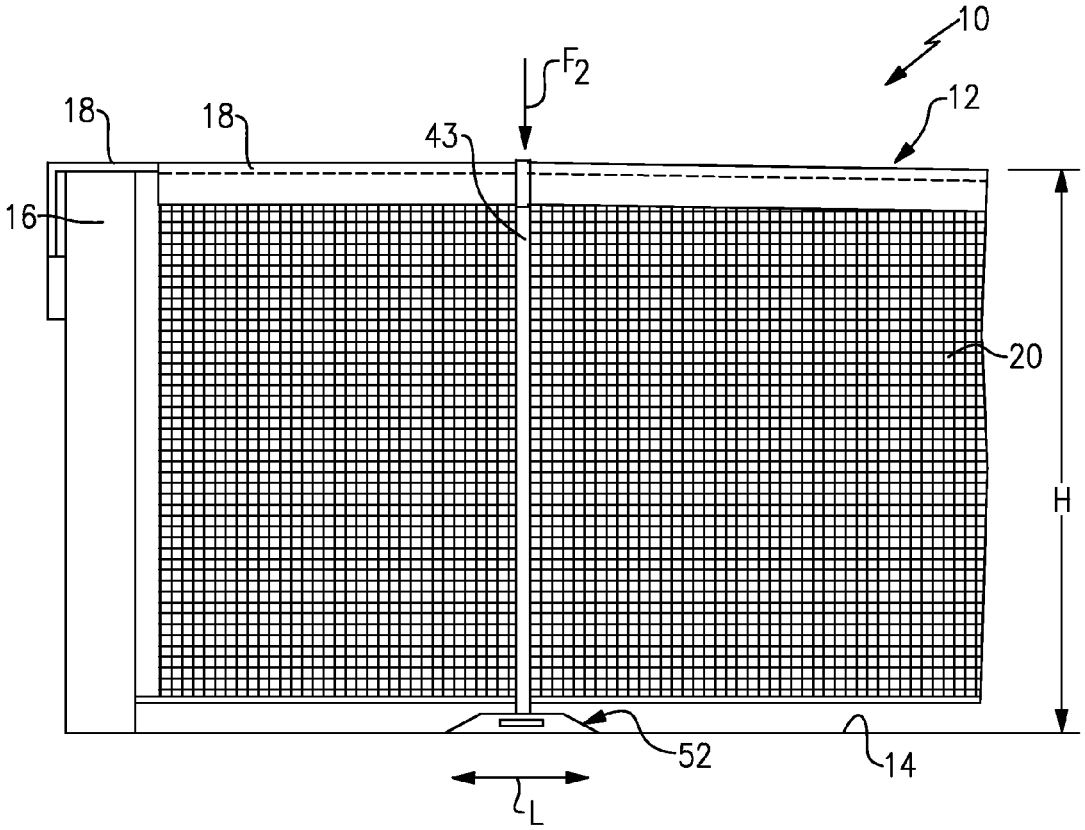
FIG. 4 is a view of still another example net tension system.

The net 12 is supported on opposite sides of the playing area 14 by net posts 16 (FIG. 4). The net 12 includes an upper cable 18 (or, "net cable") supporting a mesh (or, netting) 20. The upper cable 18 spans the distance between the net posts 16. At least one of the net posts includes a crank (not shown) for adjusting the tension in the upper cable 18. This tension, in turn, tightens the net 12. For all intents and purposes, the term net tension describes the tightness of the net, and is directly related to the tension in the upper cable 18, as well as the force exerted by the net 12 on one or more connectors provided between the net 12 and the playing area 14 (such as the center-strap 22 and the singles stick 43).

The net 12 is connected to the playing surface 14, in this example, by a center-strap 22. The upper cable 18 exerts an upward force $F_1$ on the center-strap 22 in a direction substantially perpendicular to the length L of the net 12. This is because the net 12 is higher at each end (e.g., the net posts 16 are at 107 cm height) than in the middle, so the center-strap 22 necessarily pulls down upon the net 12, creating the upward force $F_1$. The center-strap 22 resists the force $F_1$ with an equal and opposite force to maintain the net 12 in a normal condition (the pre-determined height of the center-strap 22). The force $F_1$ is resisted by way of the center-strap 22 being connected to the playing surface 14. In one example, the center-strap 22 is connected to the playing surface by a cable 24 attached to a first connecting support 26, which is selectively attachable to a hook 28.

In one example of this disclosure, a scale 30 measures the force $F_1$ exerted by the upper cable 18 on the center-strap. The force $F_1$ is indicative of a tension in the net 12. That is, the higher the tension of the upper cable 18, the higher the force $F_1$ against the center strap 22. As used herein, the term "scale" refers to any force measuring device, including, but not limited to pull scales 32A-32D (FIG. 3A), compression scales, and load cells (such as tension load cells and tension meters). A system 10 solely for determining net tension would work with a standard scale, while a service let indicator (discussed below) may require a faster load cell to obtain speeds high enough to register a ball strike. In the example where the scale 30 is a load cell, such as an electronic load cell, the system 10 may include an amplifier/digitizer and other associated electronic components. The scale may be digital (as in pull scale 32D), or mechanical (e.g., spring-type, as in pull scales 32A-32C).

Figure 2:
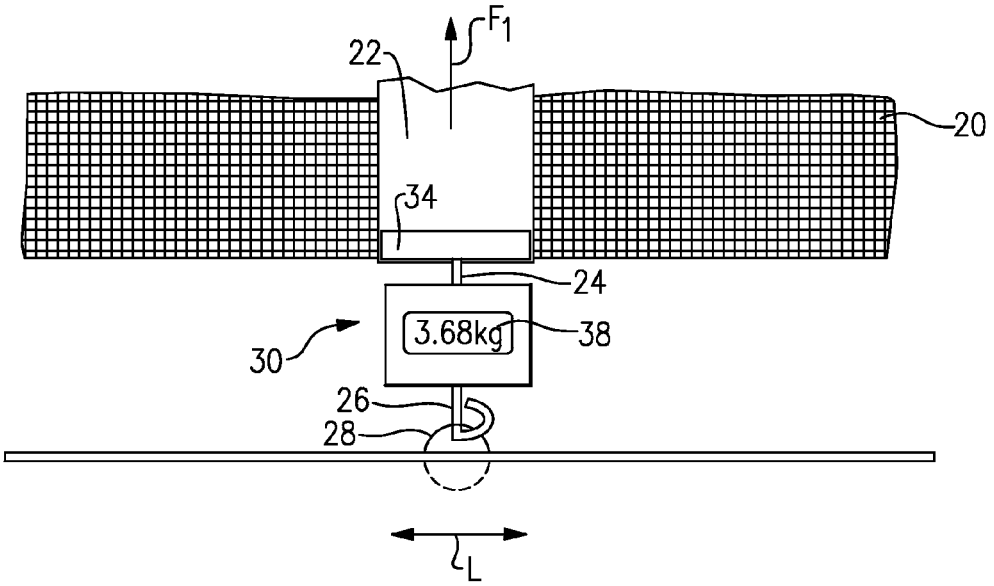
FIG. 2 is a close-up view of the system of FIG. 1.

As shown in FIG. 2, the scale 30 may be attached to the center-strap 22 by a cable 24, which can be connected to the center-strap 22 via a second connecting support 34. The first connecting support 26 is connected to the playing surface 14 via the hook 28, which is typically built-into tennis courts. If desired, an extension of the center-strap 22 can be attached via the first connecting support 26 to hang downwards and hide the scale 30. Alternatively, the color of the scale 30 may be selected to blend in with the net 12 or playing surface 14. The scale 30 may be connected to the center-strap 22 in other ways.

Figure 3A:
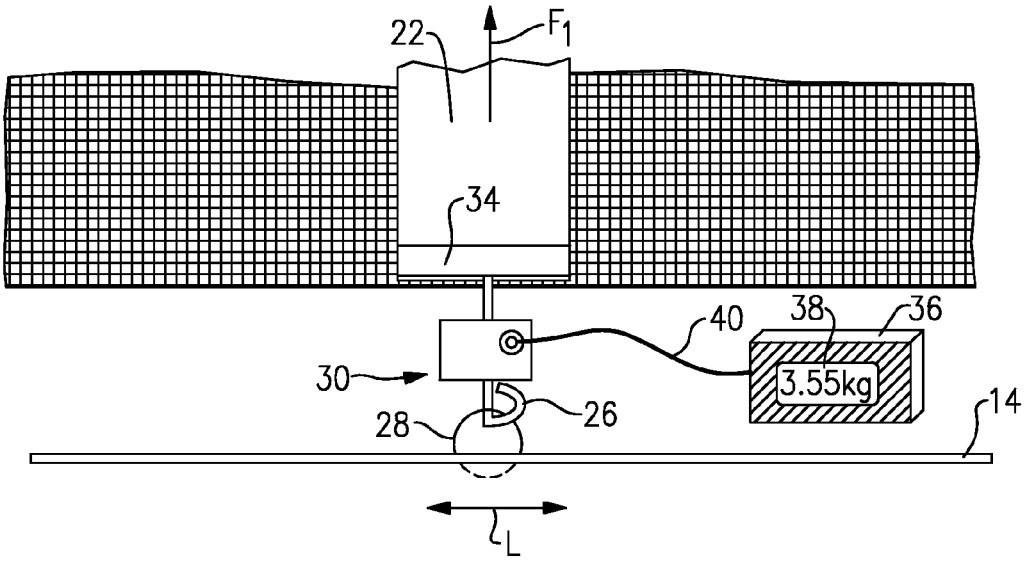
FIG. 3A is a view of another example net tension system.

As illustrated in FIG. 2, the scale 30 may include an indicator 36 expressing the force $F_1$ measured by the scale 30. In FIG. 2, the indicator 36 includes a digital display 38 that graphically expresses the measured force as a numerical quantity. The indicator 36 of FIG. 2 is attached to the scale 30. In other examples, such as in FIG. 3A, the indicator 36 is provided separately from the scale 30. In FIG. 3A, the indicator 36 may be selectively plugged into the scale 30, via cable 40, to obtain the force measurement. Alternatively, the indicator 36 may be in wireless communication with the scale 30. In one example, the indicator 36 is mounted near a chair umpire or other appropriate official for monitoring during the course of a tennis match. The indicator may include standard buttons, such as power, reset, etc. Because the tension of the net is directly correlated to the height of the net, this will alert the chair umpire (or other official) that, for example, the center-strap 22 has loosened (thus the tension will be lower), allowing the umpire to adjust it at an appropriate time during the match.

While this disclosure extends to all types of indicators 36, the indicator 36 of FIG. 3A may have the advantage of only being used during measurement, and not being exposed and vulnerable to damage during play. The indicator 36 of FIG. 3A further takes up less space, and is not readily visible, compared to that of FIG. 2. Moreover, since there are often several courts in any tennis club or professional tennis tournament, the (potentially) more expensive digital readout of the indicator 36 of FIG. 3A need not be purchased for each and every pull scale 14, since the measuring of the force $F_1$ can be done on several courts using the same indicator 36.

Figure 3B:
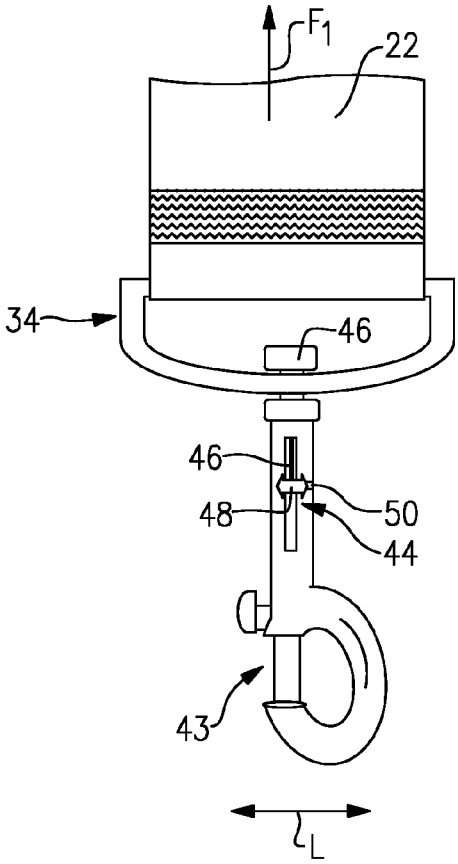
FIG. 3B is a view of yet another example net tension system.

FIG. 3B shows a variation in which a scale is built into a standard latching found in most tennis center-straps 22. The result is a scale and latching combination that is not appreciably larger than any standard latching. In one example, a pull scale 44 is incorporated into the latching 42. The pull scale 44 may include a spring acting on pin 46, which is connected to the center-strap 22 via the second connecting support 34. The pin 46 is moveable is responsive to the force $F_1$. The pin 46 is attached to an indicator 48 that moves relative to indicia 50. In one example, the indicia 50 corresponds to a preferred net tension. Other indicia may be present.

Figure 3C:
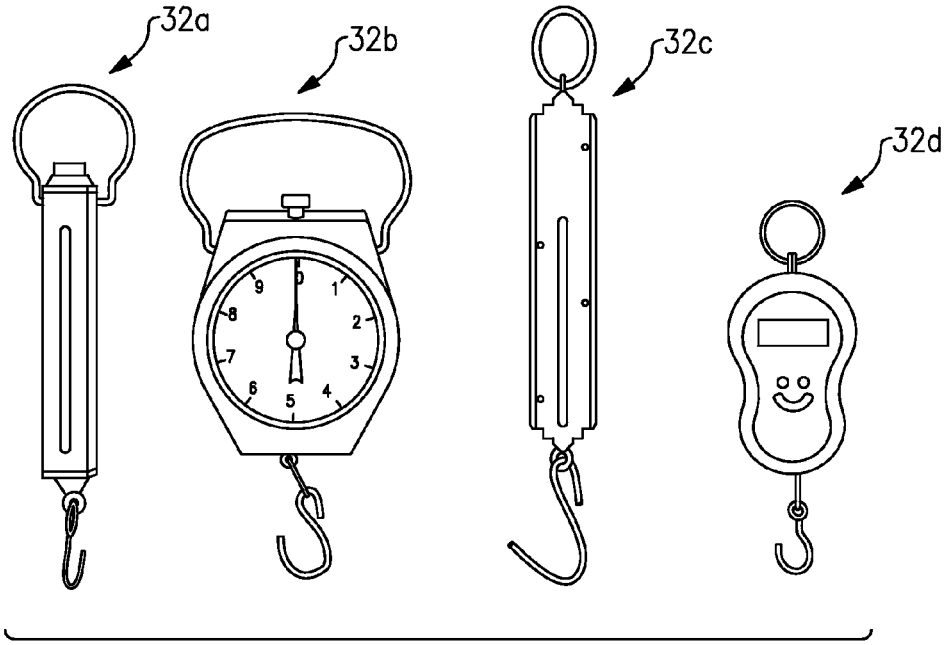
FIG. 3C illustrate example pull scales for use in the system of FIGS. 1-3A.

FIG. 3C shows three pull scales (e.g., 32A-32C) which are not electronic. While perhaps not as accurate or as easy to read, they have the potential advantage of greater durability, lower cost, and avoid the issue of batteries. These first three scales can be incorporated into this disclosure, should one desire a non-electronic scale. The fourth scale 32D is an example of an off the shelf pocket size digital pull scale.

As the upper cable 18 is adjusted, the force $F_1$ will change, and, in turn, so will the height H of the net 12 (between the net post 18 or the singles stick 43, and the center-strap 22) and the overall tension in the upper cable 18. In one example, a loose net may indicate a force $F_1$ of 4.5 kg while a tight net might show a force $F_1$ of 5.8 kg (approximately 44 N and 57 N, respectively). The scale 30 can accurately measure the force $F_1$. In the example of FIGS. 1-3B, the measurement is made at a point furthest away from the net posts 16 (e.g., at the center-strap), which may exhibit the least tension, and is also the part of the net 12 most in play.

Thus, the force $F_1$ exerted on the center-strap 22 at this point may provide the most useful information about the overall tension of the net 12.

The measurement can be made with or without singles sticks 43 (FIG. 4), as long as all measurements obtained are consistently. This is, in part, because any change in the angle of a taut upper cable 18 necessarily increases the tension, thus the singles sticks 43 may change the force $F_1$ on the center-strap 22 (having created a more acute angle), and so measurements with/without the singles stick 43 will be markedly different. Because the placement of the singles sticks 43 must be exact, it may be preferred that the net tension is measured before the singles sticks 43 are placed, thus removing a possible variable. Further, when the upper cable 18 is cranked tighter, it moves slightly laterally and therefore may cause the singles sticks 43 to lose their exact vertical position.

Turning to another embodiment, FIG. 4 illustrates singles sticks 43 provided relative to the net 12. Singles sticks 43 may be used to provide a consistent measurement of the tension of the net 12. In this embodiment, a downward force $F_2$ from the upper cable 18 of net 12 is measured. It will be understood that the downward force $F_2$ exerted by the net 12 will vary depending on how far a particular point of measurement is from the net posts 16. A singles stick 43 is, by one example rule, positioned 91.4 cm from the sideline of a singles court. The height H of the net 12 at this point, by example, is 107 cm. As such, because the height and position of the singles stick 43 is precisely defined by the rules of tennis, it can be used to provide a uniform measurement to easily duplicate net tension. The downward force $F_2$ that the upper cable 18 exerts on the singles sticks 43, in a direction substantially perpendicular to the length L of the net 12, will accurately reflect a tension of the net 12, since the arrangement of the singles stick 43 will be the generally be consistent.

Figure 5:
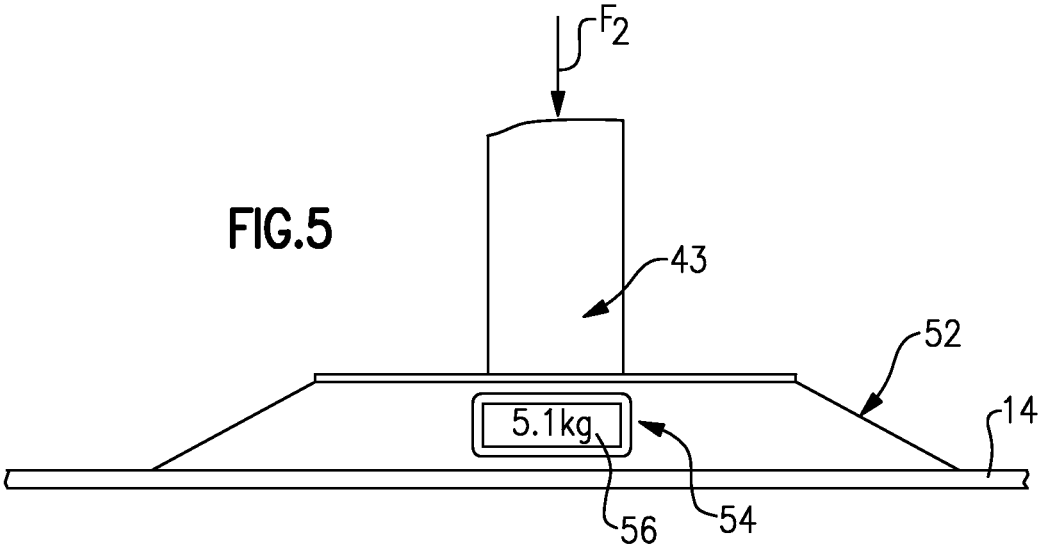
FIG. 5 is a close-up view of the example net tension system of FIG. 4.

In one example, the singles stick 43 is connected to a scale 52 at its base. Seen in detail in FIG. 5, this scale 52 can be built into the base of the singles stick 43 (as shown), built into the playing surface 14, or be a separate structure. The scale 52 may function substantially as described relative to the scale 30 of FIGS. 1-3B. For instance, the scale 52 may include an indicator 54 having a digital screen 56 for expressing the measured force $F_2$. This screen 56 can be incorporated into the scale 52 or be separate and attached via a cable when measurements are made.

While there are two singles sticks 43 commonly employed in tennis (one on each end of the net), only one stick is generally required to measure the net tension. Further, it will be appreciated that while a standard singles stick is placed 91.4 cm outside the singles sideline, one can also place the device at another point along the net.

Further, because the presence of the center-strap 22 changes the net tension, the measurements taken at the singles sticks 43 will be markedly different if a center-strap 22 is not used, or if used, not at its regulation 91.4 cm height. Thus, the presence or absence of the center-strap 22 should be noted when measuring the force $F_2$. Likewise, the presence or absence of the singles sticks 43 should be noted when measuring the force $F_1$ at the center-strap, as discussed relative to FIGS. 1-3B. This will, again, lead to consistency in the net tension.

Figure 6A:
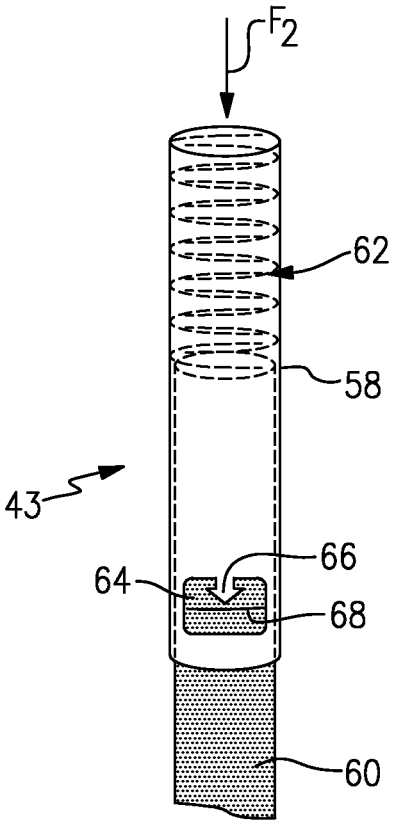
FIGS. 6A-6B show a further example net tension system.

FIG. 6A shows a non-digital scale for measuring the force $F_2$. In FIG. 6A, a singles stick 43 has a first section 58 overlapping a second section 60. The first section 58 is moveable relative to the second section 60. A spring 62 is provided inside the first section 58, and generally resists the force $F_2$ exerted on the singles stick 43 by way of the upper cable 18. Depending on the level of force $F_2$, the spring 62 will compress a corresponding amount. In turn, the first section 58 will move relative to a second section 62. The first section 58 in this example includes a window 64 and an indicator 66 that slides relative to indicia 68 on the second section 62. Like in the above examples, the indicia 68 may correspond to a preferred net tension.

Figure 6B:
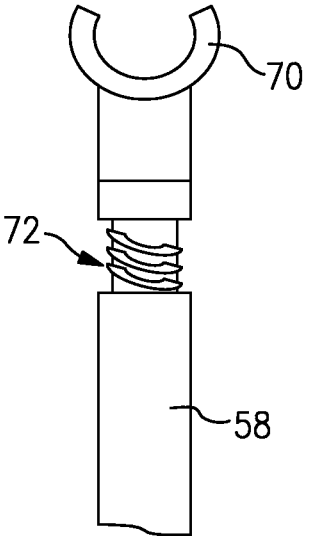

Turning to FIG. 6B, a U-shaped guide 70 may optionally be attached to the first section 58. The U-shaped guide 70 supports the upper cable 18, and may be adjustable relative to the first section 58 via threads 72. The threads 72 also allow the height of the singles stick 43 to be adjusted to meet the required 107 cm, while also allowing the singles stick 43 to customize the net tension.

Using any of the above embodiments, one can then duplicate a tension time and again. With no measureable variables, that is, the distance between the net posts (12.8 m), the inelasticity of the steel net cable, the height of the single post (107 cm), and the position of the singles stick (91.4 cm outside the single sideline), and the 91.4 cm height of the net at the center-strap, are all fixed by rule, the net tension will substantially be the exact same in each instance. This measurement can be used each time when putting a net up or can be used to simply test periodically that the net tension has remained the same.

An additional benefit of the system 10 relates to the service let rule. A serve that clips the net 12 but still falls in the service box is called a "let" and is re-played. With the instant disclosure, any ball that comes into contact with the net 12 will change the force (e.g., $F_1$ or $F_2$) caused by tension of the net 12. Such a contact and the resulting change in the force will be picked up by the scale. That is, the contact between the ball and the net changes the force $F_1$, $F_2$ from a normal level to a threshold level indicating that there has been contact between the net 12 and the ball.

The threshold force will be of an extremely short duration, and may create a unique "fingerprint" of a sharp spike (dip/peak). When the threshold force is met, an audible signal (beep) may be triggered, indicating a "let."

The fingerprint associated with the threshold force will be different than the effect that wind might have. Essentially, the effect of wind on the net tension is more of a constant push than the short-term impact associated with a ball strike. For example, even strong wind gusts have a duration in seconds, while a serve regularly is double or triple that speed, and has an impact duration in milliseconds. Measuring the change of force relative to time (e.g., how fast the force changed from one millisecond to the next one or more) will isolate the signature of a ball impact, allowing it to be identified separately from any wind effect (which will be filtered out). This unique ball strike signature can be used to set the sensitivity for what will be triggered by the threshold force, indicating a "let" ball.

For purposes of illustrating the point, in the embodiment of FIGS. 1-3B, the force $F_1$ will be steeply lower during a ball strike (indicating contact as the ball presses the net downward, counteracting (lowering) the force $F_1$ of the upward pull against the center-strap), while for the singles stick 43, the force $F_2$ shown after a ball strike will be higher (as the ball slightly presses down on the net). If the change is short enough and strong enough, the threshold force will be reached (indicating a ball strike), thus triggering a beep or signal on the chair umpire device. Typically, the chair umpire will activate the device during a serve (as balls during a "rally" which clip the net but land into play on the other side are not "lets" and are not replayed) by pressing a button, which is then released when the point is under way.

Although the different examples have the specific components shown in the illustrations, embodiments of this claimed invention are not limited to those particular combinations. It is possible to use some of the components or features from one of the examples in combination with features or components from another one of the examples. Furthermore it is appreciated that distances or features in the drawings may be reduced or exaggerated for illustrative purposes and do not in any way so limit the embodiment shown.

For example, while the forces $F_1$ and $F_2$ are substantially perpendicular to the length L of the net 12, in an alternate embodiment the scale 30 is arranged to measure the tension in the upper cable 18 directly, although this arrangement may lack sensitivity and responsiveness for the required measurements.

As another example, while specific distances such as 107 cm and 91.4 cm have been mentioned above, as currently required by all tennis governing bodies, it should be understood that this disclosure extends to systems including other distances which may include other sports which employs nets. For instance, if the regulations from the tennis governing bodies are followed, the difference between the height at the net posts 16 and the center-strap 22 will be 15.6 cm. However, in some instances the regulations are not followed, resulting in a height difference of about 15.6 cm. As used herein, the term "about" is not a boundaryless term, and should be interpreted in the way one skilled in the art would interpret the term. Similarly, measurements as described in the screen readout are given as examples only and will be different under use.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A net tension system for indicating that there has been contact between a net and a ball, comprising the net spanning a playing area, wherein the net is supported by a pair of net posts on opposite sides of the playing area;

a connector between the net posts, the net connected to the playing area by way of the connector;

a scale measuring a force exerted by the net on the connector; and an indicator expressing when a threshold force measured by the scale has been met or exceeded during a short duration, the threshold force being indicative of an impact between the ball and the net, wherein the threshold force is based upon a fingerprint, the fingerprint being a unique sharp spike in an output of the scale during the short duration.

2. The net tension system as recited in claim 1, wherein the net includes an upper cable supporting a netting, the tension in the upper cable being adjustable to adjust a net tension.

3. The net tension system as recited in claim 2, wherein the connector is a strap provided between net posts, the strap connecting the upper cable to the playing surface, wherein the scale is provided between the strap and the playing surface, the scale measuring a force exerted on the strap by the net.

4. The net tension system as recited in claim 3, wherein the force exerted on the strap by the net is caused by a deflection of about 15.6 cm in the upper cable between the net posts and the strap.

5. The net tension system as recited in claim 3, wherein the strap includes a connecting support selectively attachable to a hook connected to the playing area.

6. The net tension system as recited in claim 2, wherein the connector is a singles stick provided between the upper cable and the playing surface, and wherein the scale is provided between the playing surface and the singles stick, the scale measuring changes in the exerted on the singles stick by the net.

7. The net tension system as recited in claim 1, including an indicator expressing the force measured by the scale.

8. The net tension system as recited in claim 7, wherein the indicator is separate from the scale, and is in communication with the scale via one of (1) a wired connection and (2) a wireless connection.

9. The net tension system as recited in claim 7, wherein the indicator includes a screen expressing the measured tension by displaying a numeric force measurement.

10. The net tension system as recited in claim 7, wherein the indicator expresses the measured force by indicating a threshold force has been met or exceeded, wherein the threshold force is indicative of an impact between a ball and the net.

11. The net tension system as recited in claim 1, wherein the measured force is exerted by the net on the connector in a direction substantially perpendicular to the length of the net.

12. The net tension system as recited in claim 1, wherein the fingerprint includes both a sharp dip and a sharp peak.

13. The net tension system as recited in claim 1, wherein the fingerprint is predetermined and known to correspond to an impact between the ball and the net.

14. The net tension system as recited in claim 1, wherein the short duration corresponds to a duration during which the ball strikes the net.

15. A method for indicating that there has been contact between a net and a ball, the method comprising:

using a scale to measure a force exerted by the net on a connector, the net connected to a playing area by way of the connector, the connector provided between a pair of net posts supporting the net on opposite sides of the playing area; and using an indicator to express when a threshold force measured by the scale has been met or exceeded during a short duration, the threshold force being indicative of an impact between the ball and the net, wherein the threshold force is based upon a fingerprint, the fingerprint being a unique sharp spike in an output of the scale during the short duration.

16. The method as described in claim 15, wherein the connector is a strap connecting the net to the playing area, and wherein the measuring step includes measuring a force exerted on the strap by a net cable.

17. The method as described in claim 15, wherein the connector is a singles stick connecting the net to the playing area, and wherein the measuring step includes measuring a force exerted on the singles stick by a net cable.

18. The method as described in claim 15, wherein the fingerprint includes both a sharp dip and a sharp peak.

19. The method as described in claim 15, wherein the fingerprint is predetermined and known to correspond to an impact between the ball and the net.

20. The method as described in claim 15, wherein the short duration corresponds to a duration during which the ball strikes the net.

* * * * *